US007025919B2

(12) United States Patent
Gownder et al.

(10) Patent No.: US 7,025,919 B2
(45) Date of Patent: Apr. 11, 2006

(54) SYNDIOTACTIC POLYPROPYLENE FIBERS

(75) Inventors: Mohan Gownder, Midland, TX (US); Jay Nguyen, Pasadena, TX (US)

(73) Assignee: Fina Technology, Inc., Houston, TX (US)

( * ) Notice: Subject to any disclaimer, the term of this patent is extended or adjusted under 35 U.S.C. 154(b) by 348 days.

(21) Appl. No.: 10/112,520

(22) Filed: Mar. 28, 2002

(65) Prior Publication Data

US 2003/0187174 A1 Oct. 2, 2003

(51) Int. Cl.
*D01D 5/16* (2006.01)
*D01F 6/06* (2006.01)

(52) U.S. Cl. ..... 264/210.8

(58) Field of Classification Search ..... 264/210.8
See application file for complete search history.

(56) References Cited

U.S. PATENT DOCUMENTS

| | | | | |
|---|---|---|---|---|
| 3,258,455 | A | 6/1966 | Natta et al. | 260/93.7 |
| 3,305,538 | A | 2/1967 | Natta et al. | 260/93.7 |
| 4,298,718 | A | 11/1981 | Mayr et al. | 526/125 |
| 4,544,717 | A | 10/1985 | Mayr et al. | 526/125 |
| 4,560,734 | A | 12/1985 | Fujishita et al. | 526/142 |
| 4,701,432 | A | 10/1987 | Welborn, Jr. | 502/113 |
| 4,794,096 | A | 12/1988 | Ewen | 502/117 |
| 4,808,561 | A | 2/1989 | Welborn, Jr. | 502/104 |
| 4,892,851 | A | 1/1990 | Ewen et al. | 502/104 |
| 4,975,403 | A | 12/1990 | Ewen | 502/113 |
| 5,243,002 | A | 9/1993 | Razavi | 526/170 |
| 5,272,003 | A | 12/1993 | Peacock | 428/357 |
| 5,308,811 | A | 5/1994 | Suga et al. | 502/62 |
| 5,318,735 | A | 6/1994 | Kozulla | 526/125 |
| 5,444,134 | A | 8/1995 | Matsumoto | 526/159 |
| 5,455,305 | A * | 10/1995 | Galambos | 525/240 |
| 5,807,800 | A | 9/1998 | Shamshoum et al. | 502/104 |
| 5,908,594 | A | 6/1999 | Gownder et al. | 264/210.7 |

* cited by examiner

*Primary Examiner*—Leo B. Tentoni
(74) *Attorney, Agent, or Firm*—William D. Jackson

(57) ABSTRACT

A process for the production of partially oriented polypropylene fibers from syndiotactic polypropylene. Syndiotactic polypropylene is heated to a molten state and extruded to form a fiber preform. The fiber preform is spun at a forward spinning speed within the range of about 700–3500 meters per minute to produce a partially oriented fiber. The partially oriented fiber is wound without further substantial orientation of the fiber at a draw ratio of less than 1.5. By operating at a forward spinning speed of about 700 meters per minute or more, the partially oriented fiber has a greater tenacity than would be observed for a fiber formed from a corresponding spun isotactic polypropylene. The fiber preform is spun at a forward spinning speed of at least 100 meters per minute to provide a tenacity on the order of about 2 grams per denier or more. The fiber preform may be spun at a forward spinning speed of at least 1500 meters per minute to provide a tenacity of about 3 grams per denier.

11 Claims, 3 Drawing Sheets

SYNDIOTACTIC POLYPROPYLENE FIBERS

FIELD OF THE INVENTION

This invention relates to fibers formed of stereoregular propylene polymers and more particularly to high tenacity fibers produced from syndiotactic polypropylene and processes for their preparation.

BACKGROUND OF THE INVENTION

Isotactic and syndiotactic polypropylene are among the crystalline polymers which can be characterized in terms of the stereoregularity of the polymer chain. Various stereospecific structural relationships, characterized primarily in terms of syndiotacticity and isotacticity, may be involved in the formation of stereoregular polymers for various monomers. Stereospecific propagation may be applied in the polymerization of ethylenically-unsaturated monomers, such as $C_3$+alpha olefins, 1-dienes such as 1,3-butadiene, substituted vinyl compounds such as vinyl aromatics, e.g. styrene or vinyl chloride, vinyl chloride, vinyl ethers such as alkyl vinyl ethers, e.g, isobutyl vinyl ether, or even aryl vinyl ethers. Stereospecific polymer propagation is probably of most significance in the production of polypropylene of isotactic or syndiotactic structure.

Isotactic polypropylene is conventionally used in the production of fibers in which the polypropylene is heated and then extruded through one or more dies to produce a fiber preform which is processed by a spinning and drawing operation to produce the desired fiber product. The structure of isotactic polypropylene is characterized in terms of the methyl group attached to the tertiary carbon atoms of the successive propylene monomer units lying on the same side of the main chain of the polymer. That is, the methyl groups are characterized as being all above or below the polymer chain. Isotactic polypropylene can be illustrated by the following chemical formula:

(1)

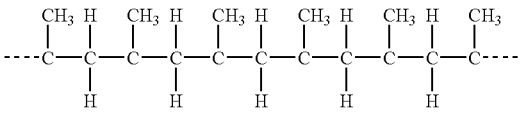

Stereoregular polymers, such as isotactic and syndiotactic polypropylene, can be characterized in terms of the Fisher projection formula. Using the Fisher projection formula, the stereochemical sequence of isotactic polypropylene, as shown by Formula (2), is described as follows:

(2)

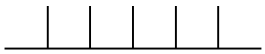

Another way of describing the structure is through the use of NMR. Bovey's NMR nomenclature for an isotactic pentad is . . . mmmm . . . with each "m" representing a "meso" diad, or successive methyl groups on the same side of the plane of the polymer chain. As is known in the art, any deviation or inversion in the structure of the chain lowers the degree of isotacticity and crystallinity of the polymer.

In contrast to the isotactic structure, syndiotactic propylene polymers are those in which the methyl groups attached to the tertiary carbon atoms of successive monomeric units in the polymer chain lie on alternate sides of the plane of the polymer. Using the Fisher projection formula, the structure of syndiotactic polypropylene can be shown as follows:

(3)

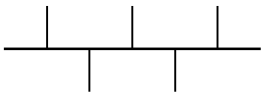

The corresponding syndiotactic pentad is rrrr with each r representing a racemic diad. Syndiotactic polymers are semi-crystalline and, like the isotactic polymers, are insoluble in xylene. This crystallinity distinguishes both syndiotactic and isotactic polymers from an atactic polymer, which is non-crystalline and highly soluble in xylene. An atactic polymer exhibits no regular order of repeating unit configurations in the polymer chain and forms essentially a waxy product. Catalysts that produce syndiotactic polypropylene are disclosed in U.S. Pat. No. 4,892,851. As disclosed there, the syndiospecific metallocene catalysts are characterized as bridged structures in which one Cp group is sterically different from the others. Specifically disclosed in the '851 patent as a syndiospecific metallocene is isopropylidene(cyclopentadienyl-1-fluorenyl) zirconium dichloride.

Catalysts that produce isotactic polyolefins are disclosed in U.S. Pat. Nos. 4,794,096 and 4,975,403. These patents disclose chiral, stereorigid metallocene catalysts that polymerize olefins to form isotactic polymers and are especially useful in the polymerization of highly isotactic polypropylene. As disclosed, for example, in the aforementioned U.S. Pat. No. 4,794,096, stereorigidity in a metallocene ligand is imparted by means of a structural bridge extending between cyclopentadienyl groups. Specifically disclosed in this patent are stereoregular hafnium metallocenes that may be characterized by the following formula:

$$R''(C_5(R')_4)_2HfQp \quad (4)$$

In Formula (4), $(C_5(R')_4)$ is a cyclopentadienyl or substituted cyclopentadienyl group, R' is independently hydrogen or a hydrocarbyl radical having 1–20 carbon atoms, and R" is a structural bridge extending between the cyclopentadienyl rings. Q is a halogen or a hydrocarbon radical, such as an alkyl, aryl, alkenyl, alkylaryl, or arylalkyl, having 1–20 carbon atoms and p is 2.

Metallocene catalysts, such as those described above, can be used either as so-called "neutral metallocenes" in which case an alumoxane, such as methylalumoxane, is used as a co-catalyst, or they can be employed as so-called "cationic metallocenes" which incorporate a stable non-coordinating anion and normally do not require the use of an alumoxane. For example, syndiospecific cationic metallocenes are disclosed in U.S. Pat. No. 5,243,002 to Razavi. As disclosed there, the metallocene cation is characterized by the cationic metallocene ligand having sterically dissimilar ring structures that are joined to a positively charged coordinating transition metal atom. The metallocene cation is associated with a stable non-coordinating counter-anion. Similar relationships can be established for isospecific metallocenes.

Catalysts employed in the polymerization of alpha-olefins may be characterized as supported catalysts or as unsupported catalysts, sometimes referred to as homogeneous catalysts. Metallocene catalysts are often employed as unsupported or homogeneous catalysts, although, as described below, they also may be employed in supported catalyst components. Traditional supported catalysts are the so-called "conventional" Ziegler-Natta catalysts, such as titanium tetrachloride supported on an active magnesium dichloride, as disclosed, for example, in U.S. Pat. Nos. 4,298,718 and 4,544,717, both to Myer et al. A supported catalyst component, as disclosed in the Myer '718 patent, includes titanium tetrachloride supported on an "active" anhydrous magnesium dihalide, such as magnesium dichloride or magnesium dibromide. The supported catalyst component in Myer '718 is employed in conjunction with a co-catalyst such as an alkylaluminum compound, for example, triethylaluminum (TEAL). The Myer '717 patent discloses a similar compound that may also incorporate an electron donor compound that may take the form of various amines, phosphenes, esters, aldehydes, and alcohols.

While metallocene catalysts are generally proposed for use as homogeneous catalysts, it is also known in the art to provide supported metallocene catalysts. As disclosed in U.S. Pat. Nos. 4,701,432 and 4,808,561, both to Welborn, a metallocene catalyst component may be employed in the form of a supported catalyst. As described in the Welborn '432 patent, the support may be any support such as talc, an inorganic oxide, or a resinous support material such as a polyolefin. Specific inorganic oxides include silica and alumina, used alone or in combination with other inorganic oxides such as magnesia, zirconia and the like. Non-metallocene metallocene transition metal compounds, such as titanium tetrachloride, are also incorporated into the supported catalyst component. The Welborn '561 patent discloses a heterogeneous catalyst that is formed by the reaction of a metallocene and an alumoxane in combination with the support material. A catalyst system embodying both a homogeneous metallocene component and a heterogeneous component, which may be a "conventional" supported Ziegler-Natta catalyst, e.g. a supported titanium tetrachloride, is disclosed in U.S. Pat. No. 5,242,876 to Shamshoum et al. Various other catalyst systems involving supported metallocene catalysts are disclosed in U.S. Pat. No. 5,308,811 to Suga et al and U.S. Pat. No. 5,444,134 to Matsumoto.

The polymers normally employed in the preparation of drawn polypropylene fibers are normally prepared through the use of conventional Ziegler-Natta catalysts of the type disclosed, for example, in the aforementioned patents to Myer et al. U.S. Pat. No. 4,560,734 to Fujishita and U.S. Pat. No. 5,318,734 to Kozulla disclose the formation of fibers by heating, extruding, melt spinning, and drawing from polypropylene produced by titanium tetrachloride-based isotactic polypropylene. Particularly, as disclosed in the patent to Kozulla, the preferred isotactic polypropylene for use in forming such fibers has a relatively broad molecular weight distribution (abbreviated MWD), as determined by the ratio of the weight average molecular weight ($M_w$) to the number average molecular ($M_n$) of about 5.5 or above. Preferably, as disclosed in the Kozulla patent, the molecular weight distribution, $M_w/M_n$, is at least 7.

A process for the production of polypropylene fibers formed from isotactic polypropylene prepared through the use of isospecific metallocene catalysts is disclosed in U.S. Pat. No. 5,908,594 to Gownder et al. As disclosed in Gownder, the polypropylene is characterized in terms of 0.5–2% of 2-1 insertions and has an isotacticity of at least 95% meso diads. This results in intermittent head-to-head insertions to provide a polymer structure that behaves somewhat in the nature of a random ethylene/propylene copolymer. The resulting fibers have good characteristics in terms of mechanical properties and machine operation, including machine speed.

A process for the production of polypropylene fibers formed from syndiotactic polypropylene is disclosed in U.S. Pat. No. 5,272,003 to Peacock. As disclosed in Peacock, the catalyst employed in the production of the syndiotactic polypropylene can be Ziegler-Natta catalyst, such as disclosed in U.S. Pat. Nos. 3,305,538 and 3,258,455 to Natta et al, or they may be prepared through the use of syndiospecific metallocene catalysts of the type disclosed in U.S. Pat. No. 4,892,851 to Ewen et al. In Peacock, the fibers and the resulting spun yarn are characterized as partially oriented (POY) or as fully oriented (FOY). Fibers employed to make a yarn of lower orientation are described in Peacock as spun at speeds below about 1500 meters per minute whereas those spun at speeds above about 2500 meters per minute are characterized as partially oriented. Peacock discloses that syndiotactic polypropylene fibers of a low orientation, i.e. at speeds below about 1500 meters per minute, should be drawn at a high draw ratio of about 4.7 to produce fully oriented yarn. For partially oriented yarn, speeds of about 2500 to 4000 meters per minute are employed with a draw ratio of about 1.5–2.0, resulting in a final wind-up of about 6000 meters per minute. Peacock goes on to describe highly oriented yarns that can be produced from spinning speeds of up to 6000 meters per minute without further drawing.

SUMMARY OF THE INVENTION

In accordance with the present invention, there is provided a process for the production of partially oriented polypropylene fibers from syndiotactic polypropylene. In carrying out the invention, a syndiotactic polypropylene polymer is heated to a molten state suitable for extrusion in a fiber-forming process. The molten syndiotactic polypropylene is extruded to form a fiber preform. The fiber preform is spun at a forward spinning speed within the range of about 700–3500 meters per minute to produce a partially oriented fiber. The partially oriented fiber is then wound without further substantial orientation of the fiber at a wind up speed preferably at the same speed as the forward spinning speed and, in any case, at a speed to result in a draw ratio of less than 1.5. By operating at a forward spinning speed of about 700 meters per minute or more, the partially oriented fiber has a greater tenacity than would be observed for a fiber formed from a corresponding spun isotactic polypropylene. Preferably, the fiber preform is spun at a forward spinning speed of at least 1,000 meters per minute. By operating under this condition, a tenacity on the order of about 2 grams per denier or more can be achieved. In yet a further embodiment of the invention, the fiber preform is spun at a forward spinning speed of at least 1500 meters per minute. By operating under this condition, a tenacity of about 3 grams per denier can be achieved.

In a further aspect of the invention, there is provided an elongated fiber product comprising a partially oriented polypropylene fiber that is prepared from syndiotactic polypropylene. The fiber product is prepared by spinning the syndiotactic polypropylene at a forward spinning speed within the range of about 700–3500 meters per minute without subsequent drawing of the partially oriented fiber. Alternatively, the partially oriented fiber can be subject to modest further drawing usually as a result of operation of the wind-up reel so long as the draw ratio is maintained at a value of less than 1.5. Preferably, the draw ratio is substantially less than 1.5, usually no more than 1.2 with a draw ratio of about 1, i.e. without further drawing being preferred.

DETAILED DESCRIPTION OF THE INVENTION

The fiber products of the present invention are formed from syndiotactic polypropylene as described in greater detail below, and by using any suitable melt spinning procedure, such as the Fourne fiber-spinning procedure. The spinning of syndiotactic polypropylene to produce fibers in accordance with the present invention provides for desired fiber characteristics of good tenacity without the need for high draw speeds and draw ratios typically employed during the fiber-forming procedure.

The fibers produced in accordance with the present invention can be formed by any suitable melt spinning procedure, such as the Fourne melt spinning procedure, as will be understood by those skilled in the art. In using a Fourne fiber-spinning machine the syndiotactic polypropylene, typically in the form of pellets, is passed from a suitable supply source and heated to a suitable temperature for extrusion within the range of about 190°–230° C. and then through a metering pump to a spin extruder. The fiber preforms thus formed are cooled in air then applied through one or more Godets to a spinning roll, which is operated at a desired forward spinning rate. The thus-formed filaments are drawn off the spin roll to the winder that preferably is operated at substantially the same speed as the forward spinning fiber in order to produce the partially oriented fiber.

Figure 1:
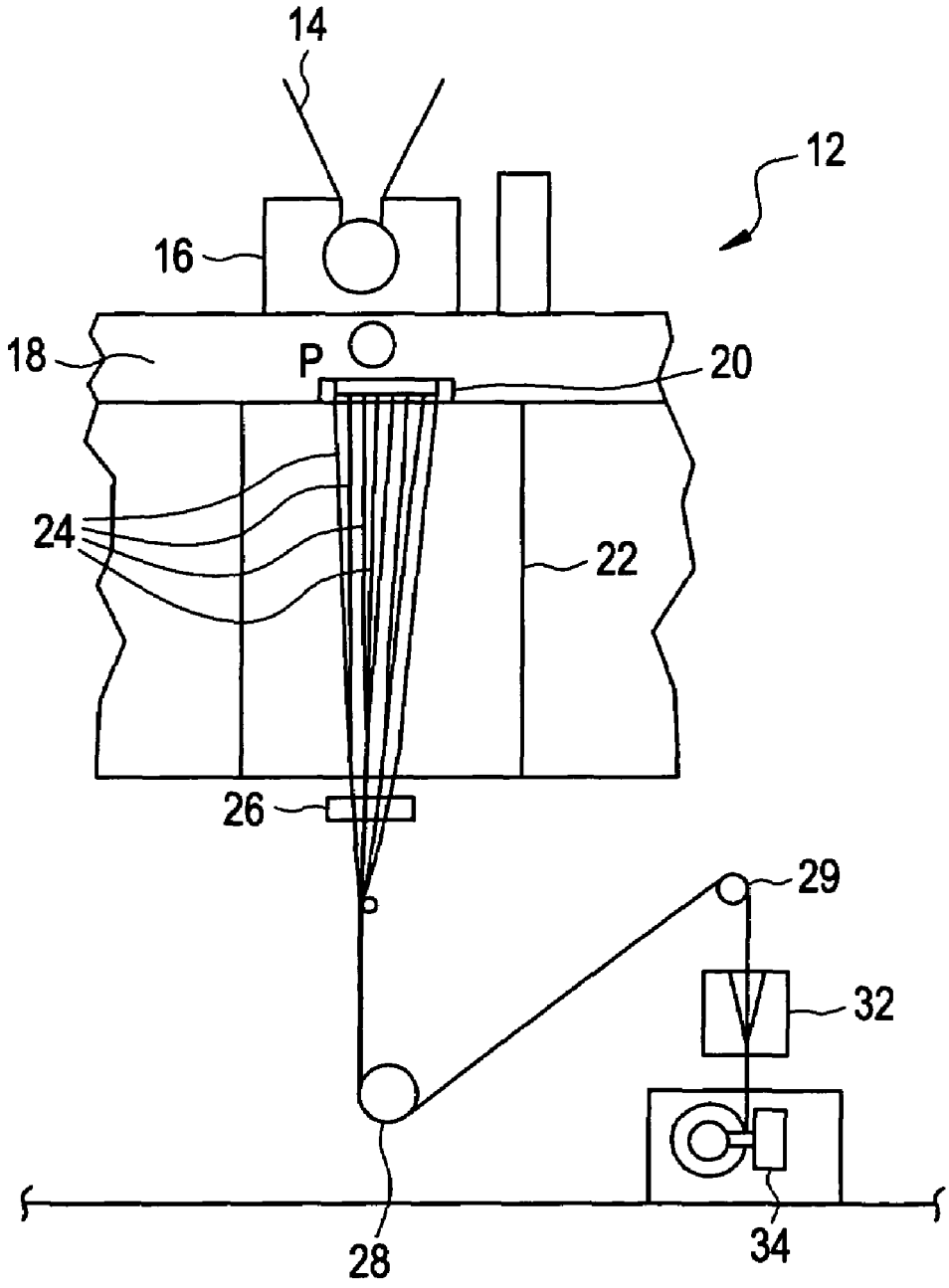
FIG. 1 is a schematic illustration of a Fourne fiber-spinning machine of the type suitable for use in carrying out the present invention.

A suitable Fourne fiber-spinning machine, which may be used in carrying out the invention, is illustrated in FIG. 1. The syndiotactic polypropylene is passed from a hopper 14 through a heat exchanger 16 where the polymer pellets are heated to the extrusion temperature and then through a metering pump 18 (also called a spin pump) to a spin extruder 20 (also called a spin pack). The portion of the machine from hopper 14 through the spin pack 20 is collectively referred to an extruder 12. The fiber preforms 24 thus formed are cooled in air in quench column 22 and then passed through a spin finisher 26. The collected fibers are then applied through one or more Godets to a take-away roller system, illustrated in this embodiment as roller 28 (also referred to as a forward spinning Godet). This roller is operated to provide a forward spinning speed of about 700–3500 meters per minute in the present invention. The thus-formed filaments are drawn off the forward spinning Godet and passed over an idler roller 29 to a winding system that is operated in a manner to minimize further substantial drawing of the filaments. This mode of operation may be contrasted with the typical mode of operation in which a second drawing Godet is employed at a speed substantially greater than the forward spinning speed to provide a substantial draw ratio to fully orient the fiber system. In one embodiment the forward spun fiber is passed through a texturizer 32 and then wound up on a winder 34. The force of winding/spinning the yarn off of the extruder does result in some stress and elongation, thus partially orienting the yarn, but does not provide a fully oriented yarn as produced by a complete drawing process. For a further description of suitable fiber-spinning procedures for use in the present invention, reference is made to the aforementioned U.S. Pat. No. 5,272,003 and U.S. Pat. No. 5,318,735, the entire disclosures of which are incorporated herein by reference.

The syndiotactic polypropylene in carrying out the present invention can be produced by polymerization in the presence of Ziegler-Natta catalysts as disclosed in the aforementioned patent to Peacock or through the use of syndiospecific metallocene catalysts. Preferably, in carrying out the invention, the syndiotactic polypropylene employed is prepared through the polymerization of syndiospecific metallocene, preferably a syndiospecific metallocene exhibiting bilateral symmetry, as disclosed for example in U.S. Pat. No. 5,807,800.

In contrast with the fiber-forming procedure of the type disclosed in Peacock, in which relatively high draw ratios are employed especially with take-away speeds of less than 4,000 meters/minute, the present invention employs take-away speeds in the low to medium range without subsequent draw ratios, typically up to about 7 as disclosed in Peacock, to produce a partially oriented yarn. In fact, by operating at take-away speeds within the range of 700–3500 meters per minutes, a partially oriented syndiotactic polypropylene yarn can be produced having a tenacity substantially greater than the tenacity of isotactic polypropylene fibers formed under the same take-away speeds.

In this respect, experimental work was carried out to develop data on tenacity versus spin speed of partially oriented fibers formed of syndiotactic polypropylene and isotactic polypropylene. As a result of this experimental work, it can be shown that partially oriented yarns can be produced at relatively low take-away spin speeds in a manner in which substantially enhanced tenacity can be achieved without a subsequent drawing step. As a result, the invention provides for the preparation of polypropylene fibers produced from syndiotactic polypropylene under relatively moderate conditions to produce fibers of surprisingly high strength.

Figure 2:
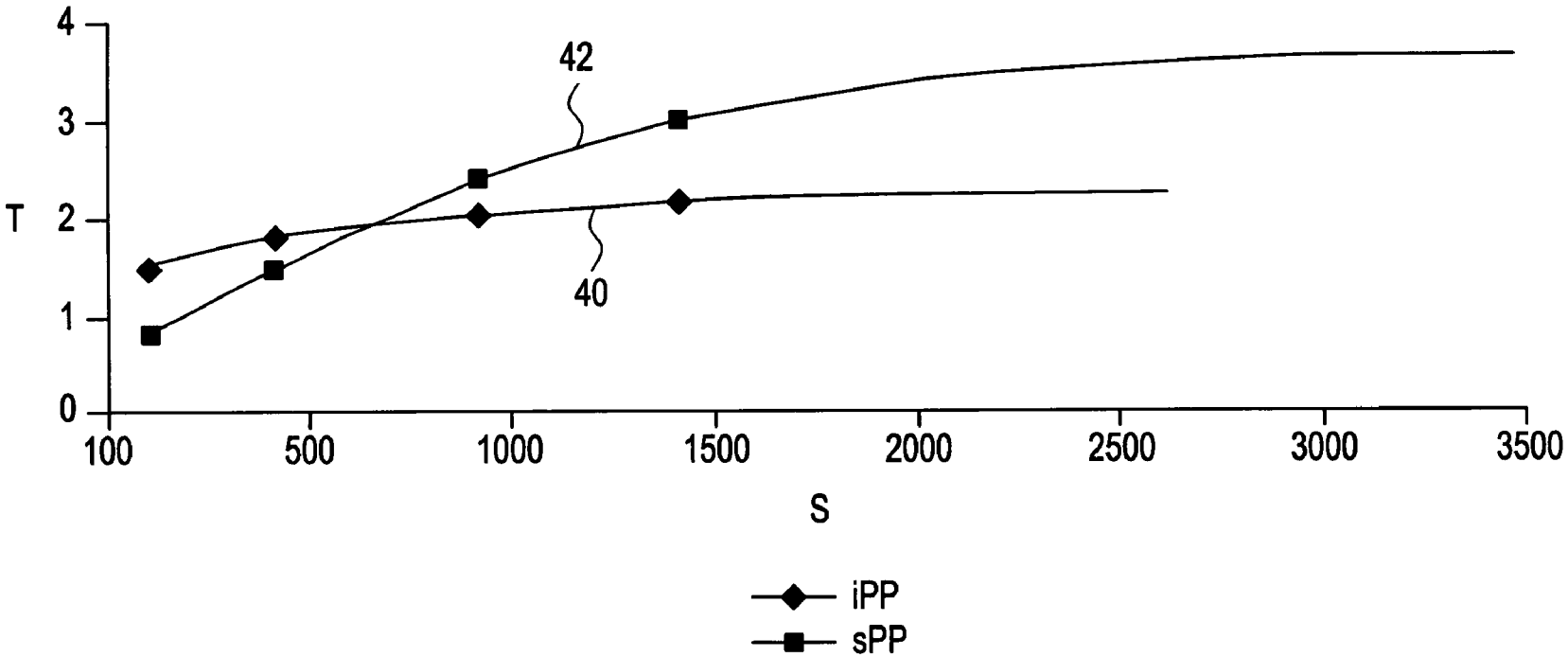
FIG. 2 is a graph illustrating the tenacity of syndiotactic polypropylene fibers as a function of forward spin speed in comparison with the tenacity of an isotactic polypropylene fiber.

Turning now to FIG. 2, there is illustrated a graph showing the tenacity T of partially oriented fibers in grams per denier plotted on the ordinate versus take-away spin speed S in meters per minute plotted on the abscissa for both isotactic polypropylene fibers and syndiotactic polypropylene fibers. In FIG. 2, curve 40 is a graph of tenacity for isotactic polypropylene fibers as a function of spin speed, whereas curve 42 is a corresponding plot of tenacity versus spin speed for syndiotactic polypropylene fibers. In both cases the fibers were produced by a Fourne fiber-spinning machine without subsequent drawing to produce a partially oriented fiber having a draw ratio of about 1. In this respect it is to be recognized that subsequent winding of the fibers can produce a minimal draw, but in this case the winder was operated at the same rate as the forward spinning speed to produce no subsequent drawing of the fiber, thus a draw ratio of about 1.

As can be seen from the examination of FIG. 2, the isotactic polypropylene fibers at very low take-away speeds—that is, a spin speed of about 200—showed substantially greater tenacity than for the syndiotactic polypropylene at this spin speed. Some advantage of the isotactic polypropylene fiber in terms of tenacity was observed at somewhat higher speeds up to about 500 to 600 meters per minute. However, at spinning speeds of about 700 meters per minute, the syndiotactic polypropylene fibers began to show an increased tenacity, relative to the isotactic polypropylene fiber. This enhanced tenacity, which became pronounced at about 1,000 meters per minute and substantially more significant at 1,500 meters per minute, continued on at higher spinning speeds. Although the maximum forward spinning speed employed in this experimental work was 1,500 meters per minute, as can be seen from extrapolating the data points shown in FIG. 2, the tenacity of the syndiotactic polypropylene can be expected to continue to increase at forward spinning speeds up to about 2,500 to 3,500 meters per minute. Since, as shown in FIG. 2, the tenacity asymptotically approaches a maximum in the region of about 3,000 to 3,500 meters per minute, indicating no further increase in tenacity in this region, it usually will be appropriate to limit the forward spinning speed to a maximum of 3,000 meters per minute and, more specifically, 2,500 meters per minute.

At the lower end of the range of spinning speeds it is preferred in carrying out the invention to spin the fiber preform at a spinning speed of at least 1,000 meters per minute and more preferably at a spinning speed of at least 1,500 meters per minute. As indicated by FIG. 2, the tenacity of the fiber reaches a value of about 3 grams per denier at this speed. Further enhancement in tenacity can be achieved by an incremental increase in spinning speed of 500 meters per minute to a spinning speed of 2,000 meters per minute, but beyond this only modest increases in tenacity are observed as indicated by curve 42 of FIG. 2. The significance of operating at a spinning speed of at least 1000 meters per minute is also indicated by x-ray diffraction studies, indicative of the crystalline structure of the polymer carried for syndiotactic polypropylene fibers partially oriented at different spinning speeds.

Figure 3:
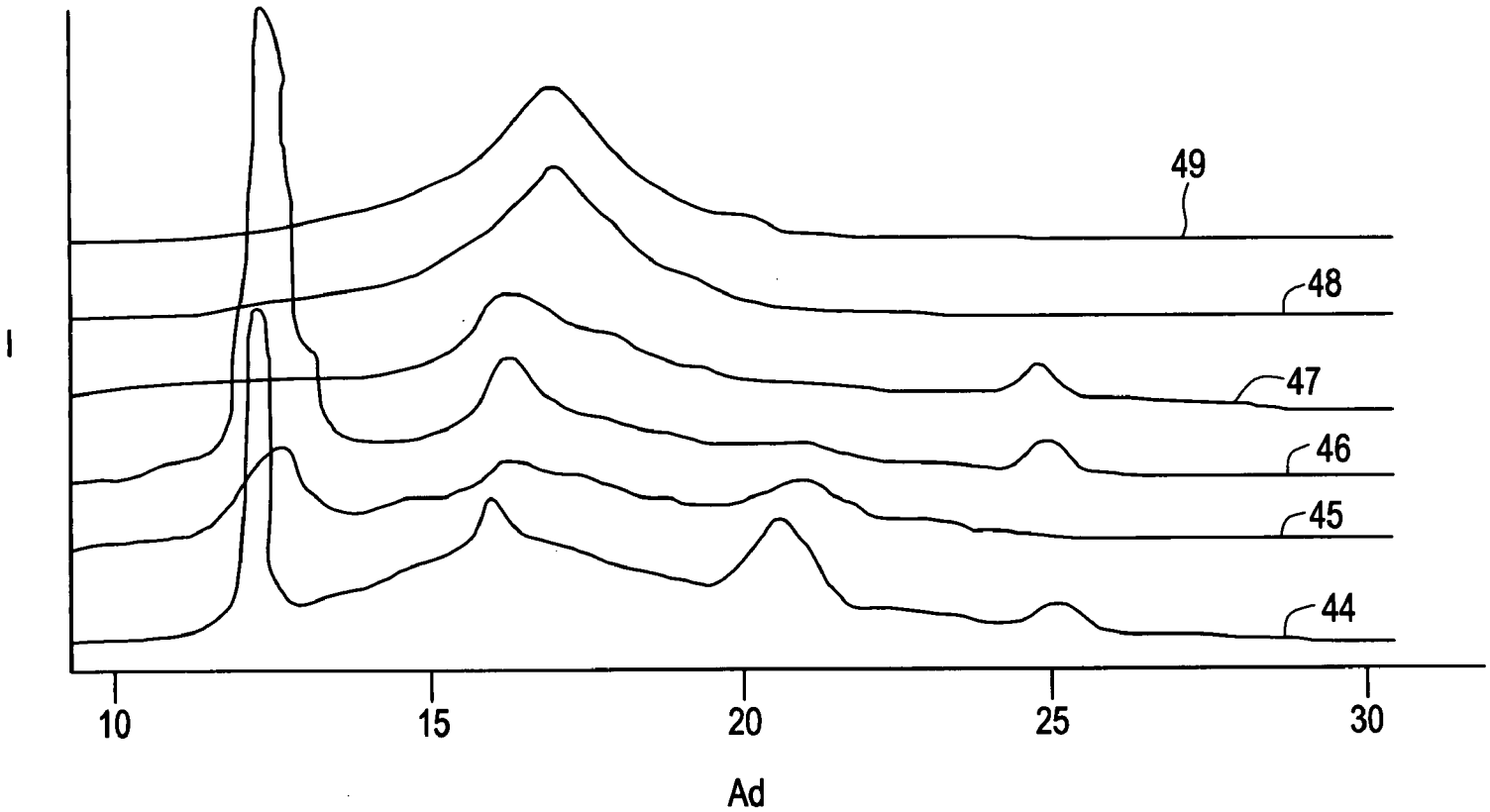
FIG. 3 is an illustration of wide-angle x-ray diffraction patterns for syndiotactic polypropylene fibers spun at varying forward spinning speeds with intensity plotted on the ordinate versus the x-ray diffraction angle plotted on the abscissa.

In this regard reference is made to FIG. 3 which presents graphs of partially oriented syndiotactic polypropylene fibers for spinning speeds of less than 20 meters per minute up to 1,500 meters per minute. In FIG. 3 curves 44–49 illustrate wide-angle diffraction patterns for the syndiotactic polypropylene associated with the different spinning speeds with intensity I plotted on the ordinate versus the diffraction angle Ad plotted on the abscissa. In the data presented in FIG. 3, curve 45 represents the x-ray diffraction pattern for syndiotactic polypropylene fiber spun at a forward spinning speed of 20 meters per minute. Curve 44 shows corresponding data for an even slower spinning speed, and curves 46 and 47 show the x-ray diffraction patterns associated with spinning speeds of 200 and 500 meters per minute. The wide-angle x-ray diffraction patterns for the partially oriented syndiotactic polypropylene fibers produced at spinning speeds of 1,000 and 1,500 meters per minute are shown by curves 48 and 49, respectively. As can be seen from an examination of the data shown in FIG. 3, when going from a spinning speed of 500 meters per minute to a value of 1,000 meters per minute, the maximum peaks in the x-ray diffraction patterns undergo a dramatic shift from maxima in the 10–15° range to maxima within the 15–20° range. The x-ray diffraction pattern, when going from 1,000 to 1,500 meters per minute, is almost identical in its relative intensity, again exhibiting a maximum peak in the 15–20° range for that observed at a forward spinning speed of 1,000 meters per minute.

Preferably, the syndiotactic polypropylene used in carrying out the present invention, as noted above, is a syndiotactic polypropylene produced by the polymerization of propylene in the presence of a syndiospecific metallocene catalyst. Such catalysts preferably exhibit bilateral symmetry as that term is used, for example, in U.S. Pat. No. 5,807,800. The syndiotactic polypropylene thus produced will preferably exhibit a syndiotacticity as measured by r diads of about 90% or more with r pentads (rrrr) in an amount of about 75% or more.

Ideally, the syndiotactic polypropylene fibers would exhibit partial orientation in which there is little or no draw subsequent to initial spinning of the fiber. This condition will be observed, at least in theory, when the windup mechanism is operated at the same speed at the forward spinning speed. However, oftentimes some draw will be inevitable from a practical point of view since it may be desirable to operate the winding mechanism at a slightly greater speed than the forward spinning speed in order to maintain appropriate tension in the fiber line. Even in this case, it will usually be desirable to maintain the fiber line at a draw ratio of no more than about 1.2 to 1.

Having described specific embodiments of the present invention, it will be understood that modifications thereof may be suggested to those skilled in the art, and it is intended to cover all such modifications as fall within the scope of the appended claims.

What is claimed is:

1. A method for the production of partially oriented polypropylene fibers comprising:

(a) heating a syndiotactic polypropylene polymer to a molten state;

(b) extruding said molten polymer to form a fiber preform;

(c) spinning said fiber preform at a forward spinning speed within the range of about 700–3500 meters per minutes to produce a partially oriented fiber; and (d) winding said fiber without further substantial orientation of said fiber at a wind-up speed resulting in a draw ratio of less than 1.2.

2. The method of claim 1 wherein said fiber exhibits a wide-angle x-ray diffraction pattern having a maximum value within the range of 15–20 degrees.

3. The method of claim 1 wherein said fiber is wound at substantially the same speed as said forward spinning speed to provide a draw ratio of about 1.

4. The method of claim 1 wherein said fiber preform is spun at a forward spinning speed of no more than 3,000 meters per minute.

5. The method of claim 4 wherein said wound fiber exhibits an x-ray diffraction pattern having a peak of maximum intensity within the range of 15–20 degrees.

6. The method of claim 4 wherein said fiber preform is spun at a forward spinning speed of at least 1,000 meters per minute.

7. The method of claim 1 wherein said fiber preform is spun at a forward spinning speed of at least 1,500 meters per minute.

8. The method of claim 1 wherein said fiber preform is spun at a forward spinning speed of at no more than 2,500 meters per minute.

9. The method of claim 8 wherein said fiber exhibits a wide-angle x-ray diffraction pattern having a maximum value within the range of 15–20 degrees.

10. The method of claim 1 wherein said polymer is produced by the polymerization of propylene in the presence of a syndiospecific metallocene catalyst.

11. The method of claim 10 wherein said polymer is produced by the polymerization of propylene in the presence of a syndiospecific metallocene catalyst exhibiting bilateral symmetry.

* * * * *